United States Patent [19]

Ray et al.

[11] 4,430,115

[45] Feb. 7, 1984

[54] BORON STAINLESS STEEL POWDER AND RAPID SOLIDIFICATION METHOD

[75] Inventors: Ranjan Ray, Burlington, Mass.; Donald E. Polk, Washington, D.C.; Bill C. Giessen, Cambridge, Mass.

[73] Assignee: Marko Materials, Inc., N. Billerica, Mass.

[21] Appl. No.: 153,775

[22] Filed: May 27, 1980

[51] Int. Cl.[3] ..... B22F 1/00; B22F 1/04

[52] U.S. Cl. ..... 75/0.5 R; 75/0.5 BA; 75/251

[58] Field of Search ..... 75/0.5 BA, 251–255, 75/124, 126 A, 126 B, 126 C, 126 D, 126 E, 126 F, 126 H, 126 P, 126 J, 126 Q, 128 A, 128 B, 128 C, 128 D, 128 F, 128 G, 128 Z, 128 T, 128 W, 128 V

[56] References Cited

U.S. PATENT DOCUMENTS

| | | | |
|---|---|---|---|
| 3,352,666 | 11/1967 | Foster et al. | 75/128 F |
| 3,598,567 | 8/1971 | Grant | 75/0.5 BA |
| 3,970,445 | 7/1976 | Gale et al. | 75/126 P |
| 4,014,680 | 3/1977 | Reen | 75/0.5 BA |
| 4,066,422 | 1/1978 | Moen | 75/0.5 BA |
| 4,240,824 | 12/1980 | Moskowitz | 75/251 |
| 4,304,593 | 12/1981 | Maeland | 241/23 |

FOREIGN PATENT DOCUMENTS

| | | | |
|---|---|---|---|
| 1247668 | 8/1967 | Fed. Rep. of Germany | 75/0.5 BA |
| 55-89459 | 7/1980 | Japan | 75/128 F |
| 55-148701 | 11/1980 | Japan | |

OTHER PUBLICATIONS

Ruhl, R. C., et al., "Splat Quenching of Fe–B Alloys", *Trans. of the Metallurgical Soc. of AIME*, vol. 245, pp. 253–257, (2/69).

*Primary Examiner*—Michael L. Lewis

*Attorney, Agent, or Firm*—Morse, Altman & Dacey

[57] ABSTRACT

Alloys having composition similar to commercial precipitation-hardenable stainless steels, but modified by the addition of 1.4 to 2.4 wt % boron, are disclosed. The alloys are subjected to a rapid solidification processing (RSP) technique which produces cooling rates between $\sim 10^5$–$10^7$ °C./sec. The as-quenched RSP ribbon or powder, etc., consists primarily of a metastable crystalline solid solution phase. The metastable crystalline phases are subjected to suitable heat treatments so as to produce a transformation to a stable multiphase microstructure, which includes borides; this heat treated alloy exhibits superior mechanical properties and thermal stability in conjunction with good corrosion and oxidation resistance.

2 Claims, No Drawings

BORON STAINLESS STEEL POWDER AND RAPID SOLIDIFICATION METHOD

BACKGROUND OF THE INVENTION

1. Field of the Invention

The invention relates generally to rapidly solidified iron-rich metal alloys obtained by adding small amounts of boron to alloys having compositions similar to those of commercial precipitation-hardenable stainless steels. This invention also relates to the preparation of these materials in the form of powder and the consolidation of these powders (or, alternatively, the ribbon-like material obtained from melt-spinning) into bulk parts which are heat treated to have these desirable properties.

2. Description of the Prior Art

Rapid solidification processing techniques offer outstanding prospects for the creation of new breeds of cost-effective engineering materials with superior properties. (See Proceedings, Int. Conf. on Rapid Solidification Processing, Reston, Va., Nov. 1977, published by Claitor's Publishing Division, Baton Rouge, La., 1978.) Metallic glasses, microcrystalline alloys, highly supersaturated solid solutions and ultrafine grained alloys with highly refined microstructures, in each case often having complete chemical homogeneity, are some of the products that can be made utilizing rapid solidification processing (RSP). (See Rapidly Quenched Metals, 3rd Int. Conf., Vol. 1 & 2, B. Cantor, Ed., The Metals Society, London, 1978.)

Several techniques are well established in the state of the art to economically fabricate rapidly solidified alloys (at cooling rates of $\sim 10^5$ to $10^7$° C./sec) as ribbons, filaments, wire, flakes or powders in large quantities. One well known example is melt spin chill casting, whereby the melt is spread as a thin layer on a conductive metallic substrate moving at high speed (see Proc. Int. Conf. on Rapid Solidification Processing, Reston, Va., Nov. 1977, p. 246.)

The current technological interest in materials produced by rapid solidification processing, especially when followed by consolidation into bulk parts, may be traced, in part, to the problems associated with the chemical segregation that occurs in complex, highly alloyed materials during the conventional procedure of ingot casting and processing. During the slow cooling characteristic of casting processes, solute partitioning, i.e., macro- and micro-segregation within the different alloys phases present in these alloys, and the formation of undesirable, massive grain boundary eutectic phases can occur. Metal powders produced directly from the melt by conventional techniques, i.e., inert gas or water atomization of the melt, are usually cooled at rates three to four orders of magnitude lower than those that can be obtained by rapid solidification processing. Rapid solidification processing removes macro-segregation altogether and significantly reduces the spacing over which micro-segregation occurs, if it occurs at all.

The design of alloys made by conventional slow cooling processes is largely influenced by the corresponding equilibrium phase diagrams, which indicate the existence and coexistence of the phases present in thermodynamic equilibrium. Alloys prepared by such processes are in, or at least near, equilibrium. The advent of rapid quenching from the melt has enabled materials scientists to stray further from the state of equilibrium and has greatly widened the range of new alloys with unique structures and properties available for technological applications. Thus, it is known that the metalloid boron has only very low solid solubility in the transition metal Fe. Alloys of Fe containing significant amounts of boron, e.g., in the range of 1–2 wt%, prepared by conventional technology have, at most, limited usefulness because they are extremely brittle. This brittleness is due to a network of a hard and brittle eutectic boride phase present along the boundaries of the primary grains of the alloys.

The presence of these hard borides in these alloys could be advantageous if they could be made to be finely dispersed in the matrix metals in the same manner in which certain precipitates are dispersed in precipitation-hardened or dispersion-hardened commercial alloys based on Al, Cu, Fe, Ni, Co and the like.

Several classes of iron-rich alloys combining relatively high strength with corrosion resistance, collectively labelled the precipitation-hardenable (PH) stainless steels (see Handbook of Stainless Steels, D. Peckner and I. M. Bernstein, Eds., McGraw Hill Book Co., New York, 1977, p. 7-1), are commercially available. These are labelled the austenitic, martensitic, and semiaustenitic classes, of which the latter two are the most widely used.

The semiaustenitic precipitation-hardenable stainless steels, in their solution treated or annealed condition, are essentially austenitic but also contain 5 to 20% delta ferrite. They can be transformed to martensite through a series of thermal or thermomechanical treatments, and they can be further hardened, to their final strength level, by an aging treatment to precipitate intermetallic compounds.

The martensitic precipitation-hardenable stainless steels sustain the greatest volume of usage. After solution treatment, they are always in the martensitic condition at room temperature. Age hardening, carried out between 800°–1250° F., causes the precipitation of various intermetallic compounds. Typically, such martensitic PH stainless steels contain ~0.03–0.13 wt% C, ~12–17 wt% Cr, ~4–9 wt% Ni and/or Co as well as lesser amounts of elements such as Mo, W, Al, Cu, Ti, Cb, V, Ta and N, at least some of which are generally included to produce the intermetallic precipitates.

SUMMARY OF THE INVENTION

This invention features a class of metal alloys having excellent corrosion resistance combined with high hardness and high strength when the production of these alloys includes a rapid solidification process. These alloys are similar in composition to presently available precipitation-hardenable stainless steels, but in addition contain 1.4 to 2.4 wt% boron, preferably 1.6 to 2.4 wt% boron; they can be described as $(PHSS)_{bal}B_{1.4-2.4}$ where PHSS represents an iron based alloy typical of precipitation-hardenable stainless steels. With the subscripts representing wt%, PHSS can be generalized as $Fe_{bal}Cr_{10-30}(Ni,Co)_{3-15}(Mo,W,Al,Cu,Ti,Cb,V,Ta,N)_{0.7-6}(Mn,Si)_{<3}C_{0.03-0.30}$, where the Fe comprises more than 50wt% and may also contain limited amounts of other elements which are commonly found in Fe alloys without changing the essential behavior of these alloys. Examples of PHSS alloys are ASTM A-461 (also known as Armco 17-4 PH), $Fe_{bal}Cr_{16.0}Ni_{4.3}(Cb+Ta)_{0.27}Cu_{3.3}C_{0.04}$ and ASTM A-461 (also known as Armco 17-7 PH), $Fe_{bal}Cr_{17.0}Ni_{7.0}Al_{1.2}C_{0.07}$.

Rapid solidification processing (RSP) (i.e., processing in which the liquid alloy is subjected to cooling rates of the order of $\sim 10^5$–$10^7$° C./sec) of such boron-containing alloys produces a solidified alloy having a metastable crystalline structure which is chemically homogeneous and can be heat treated and/or thermomechanically processed so as to form a fine dispersion of borides, which strengthen the alloy, as well as the other intermetallics which are commonly formed in precipitation-hardenable stainless steels. The heat treated and/or thermomechanically processed material is harder and stronger than conventional stainless steels while still exhibiting excellent corrosion resistance.

The inclusion of boron in the alloy has several advantages. It enhances the supercooling of the liquid which is achievable and makes easier the formation of a chemically homogeneous, metastable crystalline product (primarily a fcc or bcc solid solution) when a RSP process is utilized. The fine borides formed in the RSP alloy after heat treatment strengthen the metal and enhance the microstructural stability and strength at elevated temperatures. Finally, the inclusion of boron makes it possible to obtain a good yield of uniform material from melt-spinning, which is an economical RSP process. The as-quenched melt-spun ribbons are brittle and can readily be ground to a powder, a form especially useful for subsequent consolidation to the transformed (ductile) final product.

DETAILED DESCRIPTION OF THE PREFERRED EMBODIMENTS

The alloys of the present invention consist of more than 50 wt% iron and contain 10–30 wt% chromium to produce corrosion resistance and 1.4–2.4 wt% boron, preferably 1.6–2.4 wt% boron, for strengthening; they also contain Ni and/or Co at levels up to $\sim 15$ wt% as well as other elements (totaling no more than $\sim 6$ wt%) that form intermetallic precipitates within the iron matrix to further harden the alloy as well as low levels of Mn and Si. A generalized formula for these alloys is $Fe_{bal}Cr_{10\text{-}30}(Ni,Co)_{3\text{-}15}(Mo,W,Al,Cu,Ti,Cb,V,Ta,N)_{0.7\text{-}6}(Mn,Si)_{<3}\ C_{0.03\text{-}0.30}$, said composition additionally alloyed with 1.4–2.4 wt% B. The alloys may also contain limited amounts of other elements which are commonly found in Fe alloys without changing the essential behavior of the alloys.

The above-stated alloys are melted and then rapidly solidified in the form of ribbon, filament, sheet, powder and the like at cooling rates of the order of $\sim 10^5$–$10^7$° C./sec, as can be achieved by many known rapid solidification processing (RSP) methods, such as by spreading the molten alloy as a thin layer on a rapidly moving chill substrate (melt-spinning), by forced convective cooling of the atomized melt or by any other method capable of producing the aforementioned high cooling rates. The most significant effect of rapid solidification in the present invention is that it prevents formation of massive particles of the brittle boride phase in a eutectic configuration along the primary grain boundaries and the accompanying large scale compositional segregation such as will be found in these same alloys when they are solidified by conventional slow casting processes. Instead, boron is retained substantially or totally in an iron-based metastable crystalline solid solution phase. The solid solution may have a face-centered cubic (austenite), a body-centered cubic (delta ferrite) or a body-centered tetragonal (martensite) structure, depending on the exact composition. Upon cooling some alloys with cooling rates lying at the lower limit of those being used, i.e., at $\sim 10^5$° C./sec., and in particular for alloys having high boron contents, a small amount of eutectic borides may be present, although with particle sizes much finer (typically, two orders of magnitude smaller) than those obtained in conventionally cooled alloys.

The foregoing rapidly solidified alloys, consisting predominantly (more than 50%) of solid solution phase substantially supersaturated with boron, are heat treated between 600° and 1100° C. for specified lengths of time. Heat treatment times may range between 0.1 to 100 hours, usually from 1 to 10 hours. This heat treatment can be a separate annealing treatment or can occur coincident with the consolidation step. As a result of such heat treatment and hot working during hot consolidation operation, precipitation of ultrafine complex metallic borides such as MB, $M_2B$, $M_6B$, $M_{23}B_6$ and the like takes place, where M is one or more of the metals in the alloys, said particles being finely dispersed, both intragranularly and intergranularly. The particles typically have a characteristic size less than $\sim 0.5$ micron, preferably less than 0.05 micron; these particles are dispersed in an iron base matrix, having a composition similar to standard precipitation-hardenable stainless steels, which have a grain size less than $\sim 10$ micron, preferably less than 3 micron. The boride particles are dispersed throughout the interior of the grains and also along the grain boundaries. Consolidation can also be achieved by hot mechanical deformation at high strain rate whereby finer boride particles will precipitate out in the matrix.

When rapidly solidified, the above-stated alloys are brittle and hence ribbons formed by melt spinning can be readily comminuted into powder by standard methods. Furthermore, rapidly solidified powders of the above alloys prepared by comminution of brittle ribbons or, alternatively, other known methods of producing metal powders at high cooling rates directly from the melt, such as forced convective cooling by helium gas of liquid droplets, can be consolidated into bulk shapes by various standard powder metallurgical techniques. This processing will include prior or subsequent heat treatment (if the consolidation process does not in effect produce sufficient heat treatment) to produce the above-described microstructure and desirable mechanical properties combined with good corrosion resistance. Alternatively, the rapidly solidified filaments, as-formed or after partial mechanical fragmentation or chopping, can be consolidated directly without forming an intermediate powder.

When the boron content is too high, it becomes difficult to form a solid solution phase; instead, the alloys often become amorphous and can be ductile in the rapidly solidified state, making comminution of the ribbons difficult. Further, when too much boron is present, the heat treated alloy contains excessive amounts of the brittle borides such that the heat treated alloy itself is brittle and hence not desirable for most potential applications. Thus, less than 2.4 wt% boron is desirable.

At low boron contents, the alloys are difficult to form as rapidly solidified ribbons by the method of melt deposition on a rotating chill substrate, i.e., melt spinning. This is due to the inability of alloy melts with low boron contents to form a stable molten pool on the quench surface. Such alloys do not readily spread into a thin layer on a rotating substrate as required for melt spinning. Furthermore, at very low boron content, the alloys have less desirable mechanical properties in the heat treated condition because of having insufficient amounts of the strengthening borides that can be formed by these heat treatments. Thus, more than 1.4 wt% boron, preferably more than 1.6 wt% boron, is desirable.

The rapidly solidified brittle ribbons can be mechanically comminuted into powder, e.g., particle sizes smaller than 100 mesh (U.S. Standard), by standard known equipment such as a ball mill, hammer mill, pulverizer, fluid energy mill, or the like. Either powders, made either from ribbon or directly from the melt, or the filaments can be consolidated into fully dense bulk parts by various known metallurgical processing techniques such as hot isostatic pressing, hot rolling, hot extrusion, hot forging, cold pressing followed by sintering, etc.

While any of a wide variety of RSP processes can be employed in the practice of this invention, the combination of melt spinning and subsequent pulverization is preferred. The quench rate experienced by the liquid is much more uniform in the melt spinning process than for, e.g., atomization techniques. In atomization techniques, the quench rate (and hence the metastable structure and the final, heat treated structure derived therefrom) varies greatly with particle size. Screening out the larger particles formed from atomization gives material which has been subjected to a more uniform quench, but the yield is then reduced, making the process less economical. In powders made from pulverized ribbons, particles of all sizes have experienced essentially the same quench history. The melt-spinning-pulverization procedure can be practiced so as to have a high yield (e.g. >95%) of a relatively fine powder (e.g., −100 mesh).

The microstructure obtained after consolidation will depend upon the composition of the alloy and the consolidation conditions. Excessive times at very high temperatures can cause the particles to coarsen beyond the optimal submicron size and can lead to a deterioration of the properties., i.e., a decrease in hardness and strength.

After consolidation, additional heat treatments similar to those used for the same purpose for commercial PH stainless steels can be used to harden the matrix in which the particles are dispersed. These hardening treatments cause the precipitation, within the iron-rich matrix, of intermetallic phases, e.g., Ni-Al rich, Cu-rich, or Mo-containing phases, the identity of which depends on alloy composition, as occurs in the heat treatment of standard PH stainless steels.

The heat treatments which are used to harden the matrix depend upon its class. For example, a semi-austenitic type alloy, when heated in the range of 1900°-2000° F., will be austenitic when air cooled to room temperature. The alloy is softest in this condition so that any required machining of such alloys is best done at this stage. Next, "austenite conditioning" between ~1300°-1750° F. leads to the formation of some carbides; subsequent air cooling of the austenite, which is now partly depleted of carbon, to between −100° F. and room temperature leads to the formation of martensite. Following this, annealing between ~900°-1200° F.: (a) causes the precipitation of intermetallic compounds which are effective for precipitation hardening and (b) tempers the martensite, relieving stresses so as to improve the toughness, ductility and corrosion resistance.

A martensitic type alloy will be martensitic after the high temperature consolidation step. Typically, such alloys would be subjected to one heat treatment between ~800°-1250° F. to cause precipitation of the intermetallic phases and tempering of the martensite.

In each case, the intermetallic phases form because of the presence of small amounts of an appropriate alloying element in the matrix, for example, Ni, Al, Ti, Cu, Mo, Ta and/or Cb.

The fully heat treated, ductile boron-modified PH stainless steels exhibit increased hardness and strength compared to the standard commercial PH stainless steels. The alloys of the present invention typically have hardness of 700-900 Kg/mm$^2$ and tensile strengths of 350,000-400,000 psi; the heat treated standard commercial PH stainless steels typically have hardnesses ranging from 400-500 Kg/mm$^2$ and tensile strengths which do not exceed ~250,000 psi.

EXAMPLE 1

Selected semi-austenitic precipitation hardenable stainless steels (e.g. PH 15-7, AM350, 17-7 PH, PH 14-8, etc.) and martensitic precipitation hardenable stainless steel (e.g. PH 17-4, Custom 450, etc.) were alloyed with various boron contents ranging between 0.5 and 2.6 wt% boron. These boron containing alloys were melt spun, i.e. a molten jet of each alloy was directed onto a rotating copper beryllium cylinder. At low boron contents, the alloys did not form a properly quenched ribbon, i.e., some of the alloy leaving the wheel was still molten, often in the form of droplets. As the boron content increased to the vicinity of ~1.4 wt% boron, the molten jet was transformed primarily to a uniform rapidly quenched ribbon. With boron contents above ~1.6 wt% boron excellently quenched ribbons, typically ~0.0015" thick, were obtained. The quenched ribbons of alloys containing 1.4 to 2.4 wt% boron generally consisted primarily of metastable crystalline phases, in particular solid solutions, and were very brittle, thus being amenable to ready pulverization to powder. Above ~2.4 wt% boron, the rapidly solidified ribbons tended to be ductile and to contain predominantly an amorphous phase.

EXAMPLES 2-6

Table 1 lists a number of commercial semi-austenitic PH stainless steels modified by the addition of small amounts of boron to have compositions within the scope of the present invention. For example, the designation PH 15-7+1.9B refers to the composition obtained by adding 1.9 wt% boron to the commercial PH stainless steel PH 15-7.

The degree of brittleness of melt-spun ribbons can be readily characterized by a simple bend test wherein the metallic ribbon can be bent to form a loop and the diameter of the loop gradually reduced until the ribbon either fractures or bends back onto itself. For those ribbons that fracture, the breaking diameter of the loop is a measure of the degree of brittleness; the smaller the breaking diameter for a given ribbon thickness, the less brittle the ribbon is considered to be. A ribbon which bends back onto itself without breaking has deformed plastically into a "V" shape and is labelled fully ductile.

The as-quenched ribbons of the alloys in Table 1 were all found to be quite brittle and had breaking diameters of the order of 0.1" or more. These ribbons were annealed at 900° C. for two hours, followed by air cooling to room temperature; the heat treated ribbons were found to be fully ductile.

The heat treated ribbons were found to have Vicker's hardnesses ranging between 700–850 Kg/mm$^2$; this is significantly higher than that achievable for the same fully heat treated alloy without boron.

EXAMPLES 7–9

Table 2 lists the composition of commercial martensitic PH stainless steels modified by the addition of small amounts of boron to have compositions within the scope of the present invention. The as-formed melt-spun ribbons were found to be quite brittle; after annealing at 900° C. for two hours, followed by air cooling to room temperature, the ribbons became fully ductile and had high hardnesses and high strengths.

EXAMPLES 10–11

The melt-spun semi-austenitic PH stainless steels modified by the addition of boron listed in Table 3 were heat treated at 1000° C. for ½ hour followed by air cooling to room temperature (Stage 1), then heat treated at 760° C. for ½ hour followed by air cooling to room temperature (Stage 2), and then heat treated at 565° C. for 1½ hours, followed by air cooling to room temperature (Stage 3). The Vicker's hardnesses after each heat treatment are given in Table 3. The as-quenched ribbons were very brittle. Stage 1 consists of a heat treatment typical of that which could be experienced during consolidation; after stage 1, the alloy is ductile and contains a uniform dispersion of ultrafine boride particles. Stage 2 treatment causes a hardening associated with the formation of martensite. The stage 3 treatment causes additional, precipitation hardening, following which the alloys are fully ductile. These observed hardnesses after stage 3 are significantly higher than that (i.e., 450–500 Kg/mm$^2$) observed for commercial semi-austenitic PH stainless steels in the fully heat treated condition.

EXAMPLE 12

The melt-spun martensitic PH stainless steel modified by the addition of boron listed in Table 4 was heat treated for 2 hours at 900° C., followed by air cooling to room temperature (stage 1) and then heat treated at 525° C. for 1.5 hours followed by air cooling to room temperature (stage 2). The stage 1 treatment is typical of that which could be experienced during a consolidation process. The stage 2 treatment causes precipitation hardening, after which the alloy is fully ductile. It would generally be used in a condition similar to stage 2. The Vicker's hardnesses after the stage 1 and the stage 2 treatments are given in Table 4.

EXAMPLES 13–14

Two boron modified alloys within the the scope of the present invention, PH 15-7+1.9B and PH 17-4+2.3B, were tested for oxidation resistance at elevated temperatures. The rapidly solidified, as-quenched ribbons of the above, in fully heat treated condition, were exposed to 700° C. for 168 hours in air. The ribbons were found to show very little trace of oxidation.

EXAMPLES 15–17

Three precipitation hardenable stainless steels containing boron which are within the scope of the present invention are listed in Table 5. The alloys were melt spun into rapidly solidified brittle ribbons which contained predominantly a metastable crystalline solid solution phase. Each alloy became fully ductile after being heat treated at 950° C. for 0.5 hour and then air cooled to room temperature.

EXAMPLES 18–19

Two alloys within the scope of the present invention, $Fe_{74.69}Cr_{15.5}Ni_{4.5}Mo_3C_{0.2}B_{2.11}$ and $Fe_{72.03}Cr_{15.2}Ni_{7.1}Mo_{2.2}Al_{1.2}C_{0.07}B_{2.2}$, were melt spun into ribbons. The as spun ribbons were brittle and in each case were comminuted into −100 mesh powder using a commercial rotating hammer mill. The powders were extruded at 1040° C. into ductile fully dense bars which were suitable for further heat treatments, similar to those applied to standard precipitation hardenable stainless steels, to further increase their hardness.

While the invention has been described with particular reference to the specific embodiments, numerous modifications thereto will appear to those skilled in the art.

TABLE 1

Hardness of Melt-Spun Semi-Austenitic Precipitation Hardenable Stainless Steels Containing Boron After Being Annealed at 900° C. for Two Hours Followed By Air Cooling.

| Example | Alloy | Composition of Base PHSS (weight percent) | Hardness, Kg/mm$^2$ |
|---|---|---|---|
| 2 | PH 15-7 + 1.9B | $Fe_{bal.}Cr_{15.1}Ni_{7.1}Mo_{2.2}Al_{1.2}C_{.09}$ | 850 |
| 3 | AM-350 + 1.9B | $Fe_{bal.}Cr_{16.5}Ni_{4.25}Mo_{2.75}C_{.10}$ | 850 |
| 4 | 17-7 PH + 1.9B | $Fe_{bal.}Cr_{17.0}Ni_{7.0}Al_{1.2}C_{.09}$ | 714 |
| 5 | AM 355 2.1B | $Fe_{bal.}Cr_{15.5}Ni_{4.25}Mo_{2.75}C_{.15}$ | 782 |
| 6 | PH 14-8 + 2.1B | $Fe_{bal.}Cr_{15.1}Ni_{8.3}Mo_{2.2}Al_{1.2}C_{.05}$ | 818 |

TABLE 2

Hardness of Melt-Spun Martensitic Precipitation-Hardenable Stainless Steel Containing Boron After Being Annealed at 900° C. for Two Hours Followed By Air Cooling.

| Example | Alloy | Composition of Base PHSS (weight percent) | Hardness, Kg/mm$^2$ |
|---|---|---|---|
| 7 | 17-4 PH + 2.3B | $Fe_{bal}Cr_{16.0}Cu_{3.3}Ni_{4.3}C_{.05}$ | 858 |
| 8 | Custom 450 + 1.9B | $Fe_{bal}Cr_{15.0}Cu_{1.5}Ni_{6.0}Cb_{.3}C_{.04}$ | 782 |
| 9 | 15-5 PH + 2B | $Fe_{bal}Cr_{15.0}Cu_{2.7}Ni_{4.6}Cb_{.27}C_{.04}$ | 759 |

TABLE 3

Hardness of Modified Semi-austenitic PH Stainless Steels After Annealing Treatments

| Example | Alloys | Stage 1 Hardness, Kg/mm$^2$ | Stage 2 Hardness, Kg/mm$^2$ | Stage 3 Hardness, Kg/mm$^2$ |
|---|---|---|---|---|
| 10 | 17-7 PH + 1.9B | 543 | 655 | 707 |
| 11 | Ph 15-7 Mo + 1.9B | 536 | 710 | 890 |

TABLE 4

Hardness of Modified Martensitic PH Stainless Steels After Annealing Treatments

| Example | Alloy | Stage 1 Hardness, Kg/mm$^2$ | Stage 2 Hardness, Kg/mm$^2$ |
|---|---|---|---|
| 12 | PH 17-4 + 2.3B | 858 | 900 |

TABLE 5

Composition of Alloys Which Were Melt Spun To Brittle Ribbons and Subsequently Heat Treated to Be Ductile and Have High Strength

| Example | Alloy Composition (wt %) |
|---|---|
| 15 | $Fe_{bal}Cr_{28}Ni_4Mo_{1.5}C_{.2}B_2$ |
| 16 | $Fe_{bal}Cr_{12}Ni_{11}Al_{1.2}Ti_{.3}C_{.07}B_2$ |
| 17 | $Fe_{bal}Cr_{16}Co_{13}Mo_5V_{.4}C_{.15}B_2$ |

Having thus described the invention, what we claim and desire to obtain by Letters Patent of the United States is:

1. An alloy in powder form wherein said powders have an average particle size of less than 60 mesh (U.S. Standard) comprising platelets having an average thickness of less than 0.1 mm and each platelet being characterized by an irregularly shaped outline resulting from fracture thereof and having the composition represented by the general formula $Fe_{Bal}Cr_{10\text{-}30}(Ni,Co)_{3\text{-}15}(Mo,W,Al,Cu,Ti,Cb,V,Ta,N)_{0.7\text{-}6}(Mn,Si)_{<3}C_{0.03\text{-}0.30}$ where the iron is present at a level of more than 50 wt% and may contain incidental impurities, said composition additionally alloyed with between 1.4 to 2.4 wt% boron, said alloy being prepared by the method comprising the steps:

(a) forming a melt of said alloy (b) depositing said melt against a rapidly moving quench surface so as to quench said melt at a rate in the range of approximately $10^{5°}$ to $10^{7°}$ C./sec and thereby form a rapidly solidified strip of said alloy characterized by predominantly body centered cubic or face centered cubic structure and (c) comminuting said strip into powders.

2. The method of making an alloy in powder form wherein said powders have an average particle size of less than 60 mesh (U.S. Standard) comprising platelets having an average thickness of less than 0.1 mm and each platelet being characterized by an irregularly shaped outline resulting from fracture thereof and having the composition represented by the general formula $Fe_{Bal}Cr_{10\text{-}30}(Ni,Co)_{3\text{-}15}(Mo,W,Al,Cu,Ti,Cb,V,Ta,N)_{0.7\text{-}6}(Mn,Si)_{<3}C_{0.03\text{-}0.30}$ where the iron is present at a level of more than 50 wt% and may contain incidental impurities, said composition additionally alloyed with between 1.4 to 2.4 wt% boron, said alloy being prepared by the method comprising the steps:

(a) forming a melt of said alloy (b) depositing said melt against a rapidly moving quench surface so as to quench said melt at a rate in the range of approximately $10^{5°}$ to $10^{7°}$ C./sec and thereby form a rapidly solidified strip of said alloy characterized by predominantly body centered cubic or face centered cubic structure and (c) comminuting said strip into powders.

* * * * *